US008449026B1

(12) United States Patent
Gutierrez et al.

(10) Patent No.: US 8,449,026 B1
(45) Date of Patent: May 28, 2013

(54) CONVERTIBLE SEATING ASSEMBLY

(76) Inventors: Gilbert Michael Gutierrez, Holland, MI (US); Shawn Marie Price, Allendale, MI (US)

( * ) Notice: Subject to any disclaimer, the term of this patent is extended or adjusted under 35 U.S.C. 154(b) by 0 days.

(21) Appl. No.: 13/103,642

(22) Filed: May 9, 2011

Related U.S. Application Data

(60) Provisional application No. 61/332,517, filed on May 7, 2010.

(51) Int. Cl.
*A47C 4/00* (2006.01)
*A47C 4/28* (2006.01)

(52) U.S. Cl.
USPC ..... 297/16.2; 297/53; 297/45

(58) Field of Classification Search
USPC ..... 297/45, 53, 354.13, 16.2, 188.01, 297/423.2, 440.24, 118
See application file for complete search history.

(56) References Cited

U.S. PATENT DOCUMENTS

| | | | | |
|---|---|---|---|---|
| 272,273 | A | 2/1883 | Leavitt, Jr. | |
| 295,971 | A | 4/1884 | Bakewell | |
| 405,038 | A | 6/1889 | Koechling | |
| 486,275 | A | 11/1892 | Butler | |
| 505,409 | A * | 9/1893 | Morrell | 5/112 |
| 1,625,106 | A | 4/1927 | Sullivan | |
| 1,660,494 | A | 2/1928 | Robertson | |
| 1,842,424 | A | 1/1932 | Ponten et al. | |
| 1,955,040 | A | 4/1934 | Wittcoff | |
| 2,001,252 | A | 5/1935 | Johnson | |
| 2,109,881 | A | 3/1938 | Goldberg | |
| 2,239,669 | A | 4/1941 | Blake | |
| 2,279,748 | A * | 4/1942 | Deak | 297/19 |
| 2,304,700 | A | 12/1942 | Manville | |
| 2,429,795 | A | 10/1947 | Blanchard et al. | |
| 2,457,978 | A | 1/1949 | Curran | |
| 2,480,196 | A | 8/1949 | Poyer | |
| 2,571,282 | A | 10/1951 | Newton et al. | |
| 2,609,864 | A | 9/1952 | Gates, Jr. | |
| 2,649,139 | A | 8/1953 | Singleton | |
| 2,713,890 | A | 7/1955 | Mack | |
| 2,865,433 | A | 12/1958 | Warner | |
| 2,884,991 | A | 5/1959 | Bloomquist | |
| 2,919,746 | A | 1/1960 | Fidel | |
| 3,007,738 | A | 11/1961 | Gardel et al. | |
| 3,215,469 | A | 11/1965 | Wamsley | |
| 3,228,724 | A * | 1/1966 | Resar | 297/45 |
| 3,285,654 | A | 11/1966 | Cramer | |
| 3,475,050 | A | 10/1969 | Leahy | |
| 3,544,157 | A | 12/1970 | Muller | |
| 3,709,557 | A | 1/1973 | Light | |
| 3,730,584 | A | 5/1973 | Uchida | |
| 3,822,424 | A | 7/1974 | Messer | |

(Continued)

FOREIGN PATENT DOCUMENTS

| | | | |
|---|---|---|---|
| GB | 2219934 A | * | 12/1989 |
| WO | WO 9009749 A | * | 9/1990 |

*Primary Examiner* — Milton Nelson, Jr.
(74) *Attorney, Agent, or Firm* — King & Partners, PLC

(57) ABSTRACT

A seating assembly adapted to be readily converted between an inoperative storage configuration and multiple operative seating configurations, including: a frame sub-assembly, wherein the frame sub-assembly includes a back section, a seat section, and a telescoping leg support section; a ground engaging leg sub-assembly; and body support member. An adjustable headrest that releasably retains a beach towel is provided. Integrated storage pockets for retaining, personal articles, paraphernalia, music players, drink bottles, etcetera are yet further provided.

16 Claims, 10 Drawing Sheets

U.S. PATENT DOCUMENTS

| | | | | |
|---|---|---|---|---|
| 3,947,903 | A | | 4/1976 | Merke |
| 4,181,356 | A | | 1/1980 | Fleischer |
| 4,190,290 | A | | 2/1980 | Strien |
| 4,194,601 | A | | 3/1980 | Yellin |
| 4,273,380 | A | | 6/1981 | Silvestri |
| 4,375,901 | A | | 3/1983 | MacDonald |
| 4,386,790 | A | | 6/1983 | Kassai |
| 4,518,198 | A | | 5/1985 | Daniels |
| 4,577,901 | A | | 3/1986 | Phillips |
| 4,595,232 | A | | 6/1986 | Glenn et al. |
| 4,614,377 | A | | 9/1986 | Luo |
| 4,684,149 | A | | 8/1987 | Meyer |
| 4,773,708 | A | | 9/1988 | Nastu |
| 4,784,436 | A | | 11/1988 | Sutherland |
| 4,801,176 | A | * | 1/1989 | Wolberg ..... 297/44 |
| 4,824,171 | A | | 4/1989 | Hollingsworth |
| 4,890,882 | A | | 1/1990 | Harrington |
| 5,429,413 | A | * | 7/1995 | Levy et al. ..... 297/45 |
| 5,620,229 | A | * | 4/1997 | Ledford ..... 297/229 |
| 5,893,605 | A | | 4/1999 | Chang |
| 5,984,406 | A | | 11/1999 | Lee |
| 6,179,374 | B1 | | 1/2001 | Tang |
| 6,454,348 | B1 | | 9/2002 | Wu |
| 6,637,811 | B2 | | 10/2003 | Zheng |
| 6,755,463 | B2 | * | 6/2004 | Lardieri et al. ..... 297/35 |

* cited by examiner

CONVERTIBLE SEATING ASSEMBLY

CROSS-REFERENCE TO RELATED APPLICATION(S)

This application claims the benefit of U.S. Provisional Application Ser. No. 61/332,517, entitled "PORTABLE AND COLLAPSIBLE BEACH CHAISE CHAIR WITH ADJUSTABLE HEAD SUPPORT, EXTENDING FOOT REST AND CARRYING CASE," filed May 7, 2010, which is hereby incorporated herein by reference in its entirety, including all references cited therein.

BACKGROUND OF THE INVENTION

1. Field of the Invention

The present invention relates in general to a seating assembly and, more particularly, to a seating assembly which is adapted to be readily converted between an inoperative storage configuration and multiple operative seating configurations.

2. Background Art

Beach chairs and associated assemblies have been known in the art for years, and are the subject of numerous patents, including, for example: U.S. Pat. No. 6,637,811 entitled "Collapsible Beach Chair with Tensioned Seat," U.S. Pat. No. 6,179,374 entitled "Collapsible Reclining Beach Chair," U.S. Pat. No. 4,890,882 entitled "Collapsible Beach Chair," U.S. Pat. No. 4,824,171 entitled "Collapsible Beach Chair," U.S. Pat. No. 4,773,708 entitled "Folding Chaise Lounge," and U.S. Pat. No. 4,375,901 entitled "Beach Chair,"—all of which are hereby incorporated herein by reference in their entirety including all references cited therein.

U.S. Pat. No. 6,637,811 appears to disclose a collapsible chair which has a pair of front legs, a pair of rear legs, a pair of back support rods, a seat, and a cross brace that slidably couples one of the back support rods to one end of the cross brace and one of the front legs. The legs, support rods and cross brace are coupled such that the chair appears to collapse in a single movement in which the front legs approximate each other when the seat pivots towards the back support rods.

U.S. Pat. No. 6,179,374 appears to disclose a reclining beach chair incorporating a frame having pairs of crossed front, rear and side legs, with each leg including a pair of bends in opposing directions in bringing the seat level of the chair closer to the ground, and with connectors for the legs and a tilt-locking mechanism for stabilizing the chair and positively fixing it at the reclining angle set when opened or folded, and for collapsing the chair to a compact package when closed.

U.S. Pat. No. 4,890,882 appears to disclose a collapsible beach chair having a seat made of parallel tubular members and a webbing stretched across to support the occupant, a pivoted back made of parallel tubular members with a webbing stretched across to support the back of the occupant, and identical end pieces to support both ends of the seat and the top of the back. Provision is made to permit the chair to be collapsed both transversely and by folding the back onto the seat after the end pieces are removed. The whole collapsed assembly will apparently fit conveniently into a zippered bag with a shoulder strap.

U.S. Pat. No. 4,824,171 appears to disclose a collapsible beach chair which is formed from a covering, such as canvas, which is folded and joined together to define a pair of seat compartments and a pair of back compartments with the compartments being joined together by a transverse hinge portion of the covering. The seat compartments are joined together by a longitudinal hinge portion of the covering separate and apart from a longitudinal hinge portion of the covering joining together the back compartments. Each compartment has therein a stiffening element which includes a rigid backing having a padded surface. The hinge portions of the covering are arranged so that the seat may be folded with all four compartments being disposed in side-by-side relationship and with the back forming compartments disposed outermost. The back forming compartments are joined together by releasable strap means and carry handles to facilitate the carrying thereof. If desired, suitable strap means may be provided for tying together the handles and there may be a shoulder carrying strap. Strap means are further disclosed between the seat compartments and the back compartments for maintaining the back compartments at selected upstanding positions relative to the seat portion.

U.S. Pat. No. 4,773,708 appears to disclose a folding chaise lounge or chair which includes a seat section having a hingedly connected back section and leg support sections which can be readily adjusted relative to each other in the unfolded position. The leg support section further includes a foot extender that is adjustably connected to extend or adjust the length of the leg support section to comfortably accommodate the comfort of persons of varying height. Included in the assembly are opposed pockets connected to the sides of the seat section which are constructed to receive, store and/or stow personal articles in either the folded or unfolded position of the chaise lounge or chair; and a handle is conveniently located to facilitate the carrying of the chaise lounge or chair in the folded position thereof. Folding leg members are hingedly connected to the opposite ends of the seat section whereby the leg members are folded inwardly to one side of the seat section as the back section and leg support section are folded inwardly to overlap each other on the opposite side of the seat section, with the pockets stowed between the folded back or leg support section and the seat section.

U.S. Pat. No. 4,375,901 appears to disclose a beach chair which includes an integral tubular frame having a top run joined on its opposite extremities with downwardly projecting side legs which terminate at their lower extremities in stakes for being driven into the beach. A tubular headrest is telescoped onto the top run and the upper extremity of a strut projects laterally through such headrest and is rotatably connected with such top run for pivoting from a collapsed position disposed in the general plane of the side legs to a supporting position angled outwardly and rearwardly from such side legs. A web is stretched between the side legs and, if desirable, an apron or flap may project from the lower extremity thereof to serve as a cover over an underlying seating area.

While the above-identified references do appear to disclose a plurality of beach chairs, chaises, and/or lounges, their configurations remain non-desirous and/or problematic inasmuch as, among other things, none of the above-identified apparatuses appear to be readily convertible between an inoperative storage configuration and multiple operative seating configurations, such as a chair configuration, a chaise configuration, and/or a lounge configuration. Moreover, the above-identified seating assemblies appear to be void of, among other things, adjustable headrests which releasably retain, for example, a beach towel, as well as effective and/or integrated stowage pockets for retaining, personal articles, paraphernalia, music players, drink bottles or cans, etcetera.

It is therefore an object of the present invention to provide a seating assembly (e.g., chair, chaise, lounge, etcetera) which, among other things, remedies the aforementioned detriments and/or complications associated with the use of the above-identified, conventional beach chairs.

These and other objects of the present invention will become apparent in light of the present specification, claims, and drawings.

SUMMARY OF THE INVENTION

In one embodiment, the present invention is directed to a seating assembly comprising: (a) a frame sub-assembly; (b) a ground engaging leg sub-assembly; (c) a body support member; (d) wherein the frame sub-assembly comprises a back section; a seat section having a left frame member with a cavity, and a right frame member with a cavity; and a leg support section having a left frame member and a right frame member; (e) wherein the seating assembly is convertible between an inoperative storage configuration and an operative seating configuration; and (f) wherein the operative seating configuration is further convertible between a chair configuration and a lounge configuration upon displacement of the left and right frame members of the leg support section from within the cavities of the seat section.

The present invention is also directed to a seating assembly adapted to be readily converted between an inoperative storage configuration and multiple operative seating configurations, comprising: (a) a frame sub-assembly, wherein the frame sub-assembly comprises: (1) a back section, (2) a seat section, and (3) a leg support section; (i) wherein the back section comprises: (1) a left frame member having an upper end and a lower end; (2) a top frame member having a left section which includes a left end and a right end, and a right section which includes a left end and a right end, and a midpoint between the left and right sections; (3) a right frame member having an upper end and a lower end; (4) wherein the upper end of the left frame member and the left end of the left section of the top frame member are hingedly connected; (5) wherein the upper end of the right frame member and the right end of the right section of the top frame member are hingedly connected; and (6) wherein the right end of the left section of the top frame member and the left end of the right section of the top frame member are hingedly connected; (ii) wherein the seat section comprises: (1) a left frame member having a cavity, an upper end, and a lower end; and a right frame member having a cavity, an upper end, and a lower end; (2) wherein the upper end of the left frame member of the seat section and the lower end of the left frame member of the back section are hingedly connected; and (3) wherein the upper end of the right frame member of the seat section and the lower end of the right frame member of the back section are hingedly connected; and (iii) wherein the leg support section comprises: (1) a left frame member having an upper end and a lower end; (2) a bottom frame member having a left section which includes a left end and a right end, and a right section which includes a left end and a right end, and a midpoint between the left and right sections; (3) a right frame member having an upper end and a lower end; (4) wherein the left frame member, the bottom frame member, and the right frame member collectively form a U-shaped leg support section which is telescopically displaceable relative to the seat section; (5) wherein the lower end of the left frame member and the left end of the left section of the bottom frame member are hingedly connected; (6) wherein the lower end of the right frame member and the right end of the right section of the bottom frame member are hingedly connected; and (7) wherein the right end of the left section of the bottom frame member and the left end of the right section of the bottom frame member are hingedly connected; (b) a ground engaging leg sub-assembly; and (c) a body support member.

The present invention is further directed to a seating assembly adapted to be readily converted between an inoperative storage configuration and multiple operative seating configurations comprising: (a) a frame sub-assembly, wherein the frame sub-assembly comprises: (1) a back section, (2) a seat section, and (3) a leg support section; (i) wherein the back section comprises: (1) a left frame member having an upper end and a lower end; (2) a top frame member having a left section which includes a left end and a right end, and a right section which includes a left end and a right end, and a midpoint between the left and right sections; (3) a right frame member having an upper end and a lower end; (4) wherein the left frame member, the top frame member and the right frame member collectively form a U-shaped back section; (5) wherein the upper end of the left frame member and the left end of the left section of the top frame member are hingedly connected; (6) wherein the upper end of the right frame member and the right end of the right section of the top frame member are hingedly connected; and (7) wherein the right end of the left section of the top frame member and the left end of the right section of the top frame member are connected via a releasably lockable hinge proximate the midpoint of the top frame member; (ii) wherein the seat section comprises: (1) a left frame member having a cavity, an upper end, and a lower end; and a right frame member having a cavity, an upper end, and a lower end; (2) wherein the upper end of the left frame member of the seat section and the lower end of the left frame member of the back section are connected via a releasably lockable hinge; and (3) wherein the upper end of the right frame member of the seat section and the lower end of the right frame member of the back section are connected via a releasably lockable hinge; and (iii) wherein the leg support section comprises: (1) a left frame member having an upper end and a lower end; (2) a bottom frame member having a left section which includes a left end and a right end, and a right section which includes a left end and a right end, and a midpoint between the left and right sections; (3) a right frame member having an upper end and a lower end; (4) wherein the left frame member, the bottom frame member, and the right frame member collectively form a U-shaped leg support section which is telescopically displaceable relative to the seat section; (5) wherein the lower end of the left frame member and the left end of the left section of the bottom frame member are hingedly connected; (6) wherein the lower end of the right frame member and the right end of the right section of the bottom frame member are hingedly connected; and (7) wherein the right end of the left section of the bottom frame member and the left end of the right section of the bottom frame member are connected via a releasably lockable hinge proximate the midpoint of the bottom frame member; (b) a ground engaging leg sub-assembly, wherein the ground engaging leg sub-assembly comprises: (1) a first leg having an upper end and a lower end; (2) a second leg having an upper end and a lower end; (3) a third leg having an upper end and a lower end; (4) a fourth leg having an upper end and a lower end; (5) wherein the upper end of the first leg is hingedly connected to the upper end of the left frame member of the seat section, and the upper end of the second leg is hingedly connected to the upper end of the right frame member of the seat section; and (6) wherein the upper end of the third leg is hingedly connected to the lower end of the left frame member of the seat section, and the upper end of the fourth leg is hingedly connected to the lower end of the right frame member of the seat section; and (c) a body support member.

BRIEF DESCRIPTION OF THE DRAWINGS

Certain embodiments of the present invention are illustrated by the accompanying figures. It will be understood that the figures are not necessarily to scale and that details not necessary for an understanding of the invention or that render other details difficult to perceive may be omitted. It will be further understood that the invention is not necessarily limited to the particular embodiments illustrated herein.

The invention will now be described with reference to the drawings wherein.

DETAILED DESCRIPTION OF THE INVENTION

Figure 1:
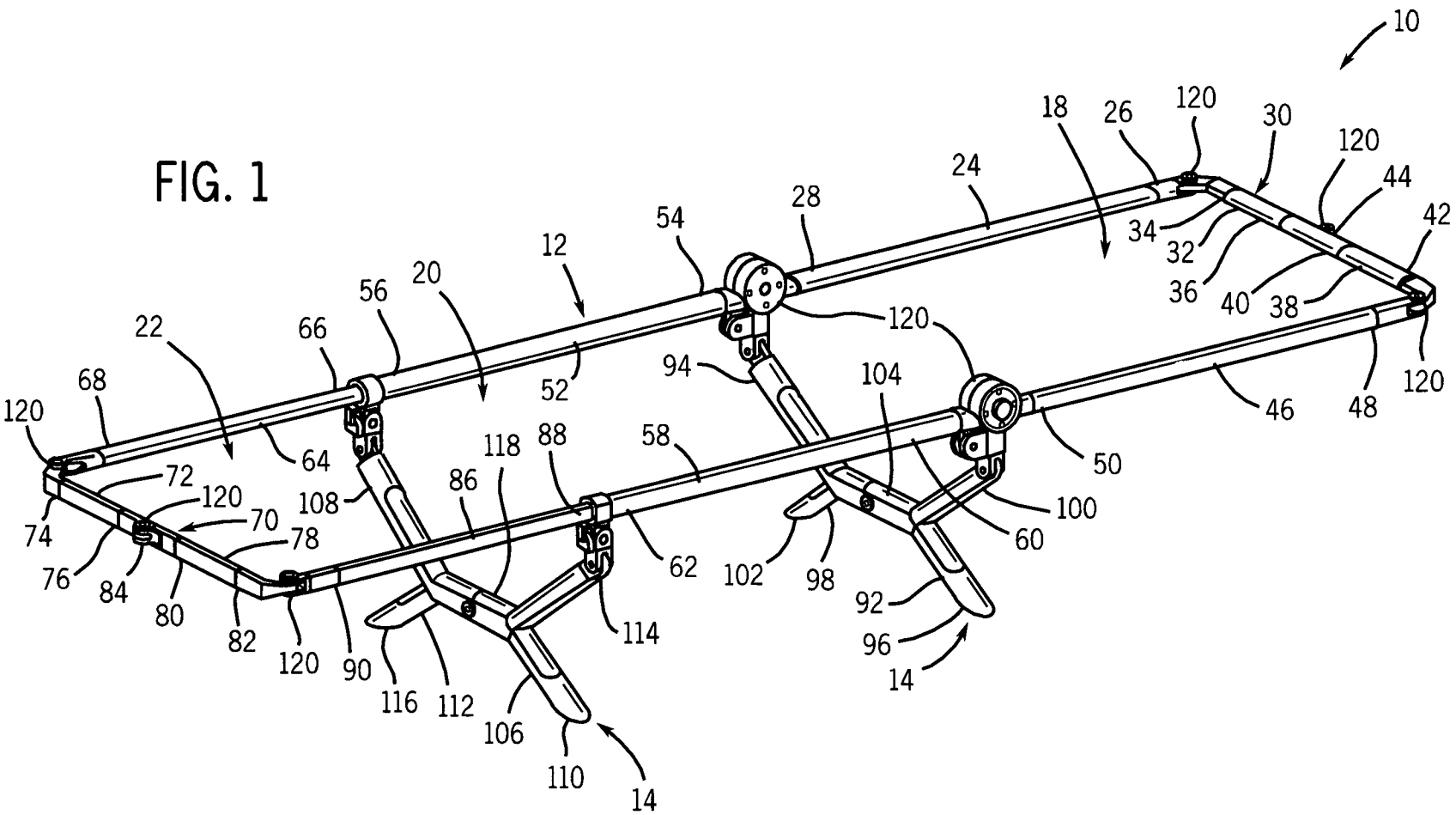
FIG. 1 of the drawings is a perspective view of a frame sub-assembly fabricated in accordance with the present invention.
Figure 2:
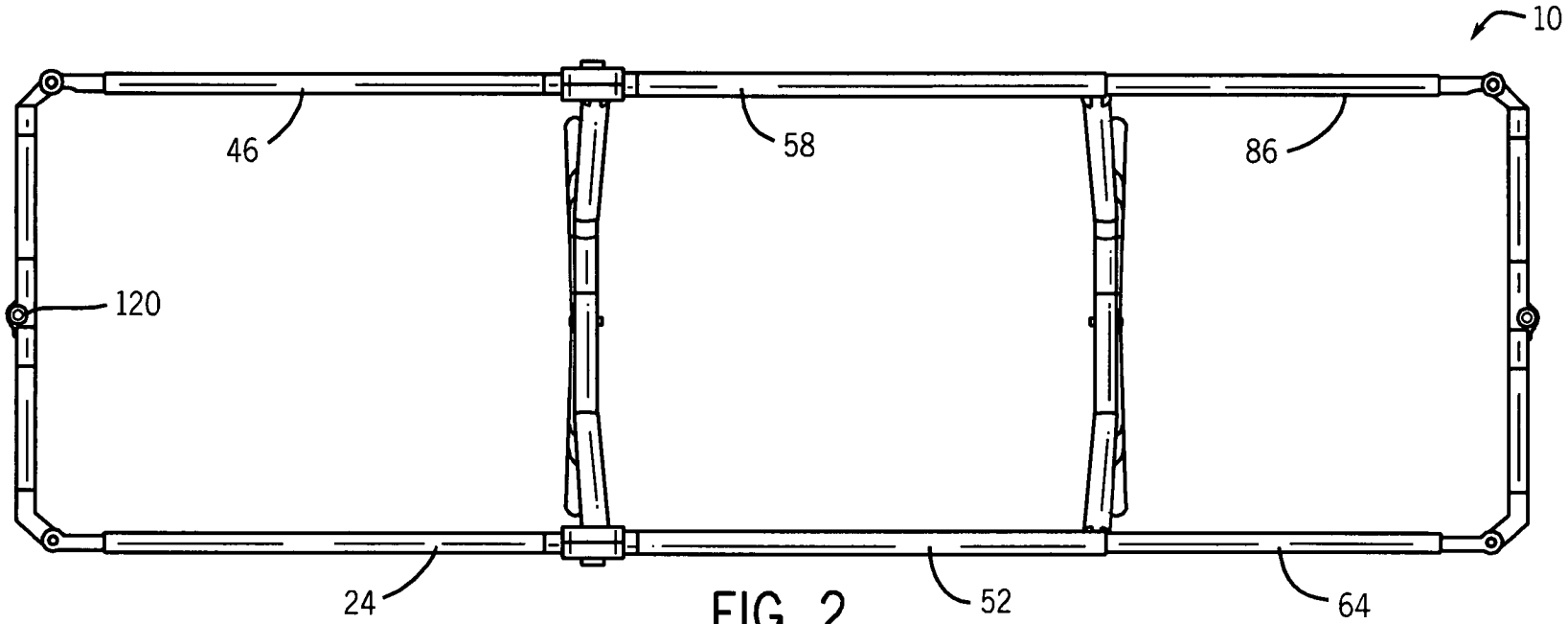
FIG. 2 of the drawings is a top plan view of a frame sub-assembly fabricated in accordance with the present invention.
Figure 3:
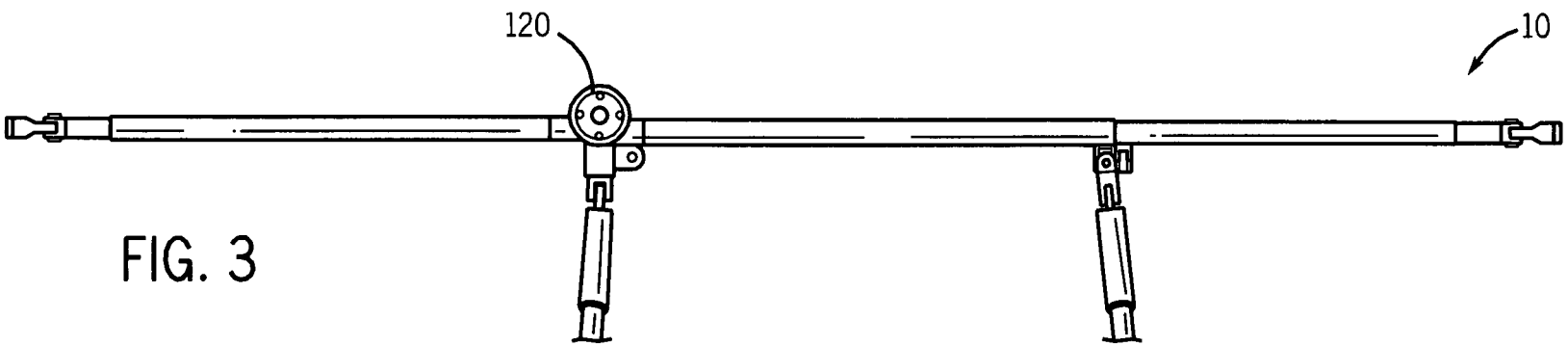
FIG. 3 of the drawings is a side elevation view of a frame sub-assembly fabricated in accordance with the present invention.
Figure 4A:
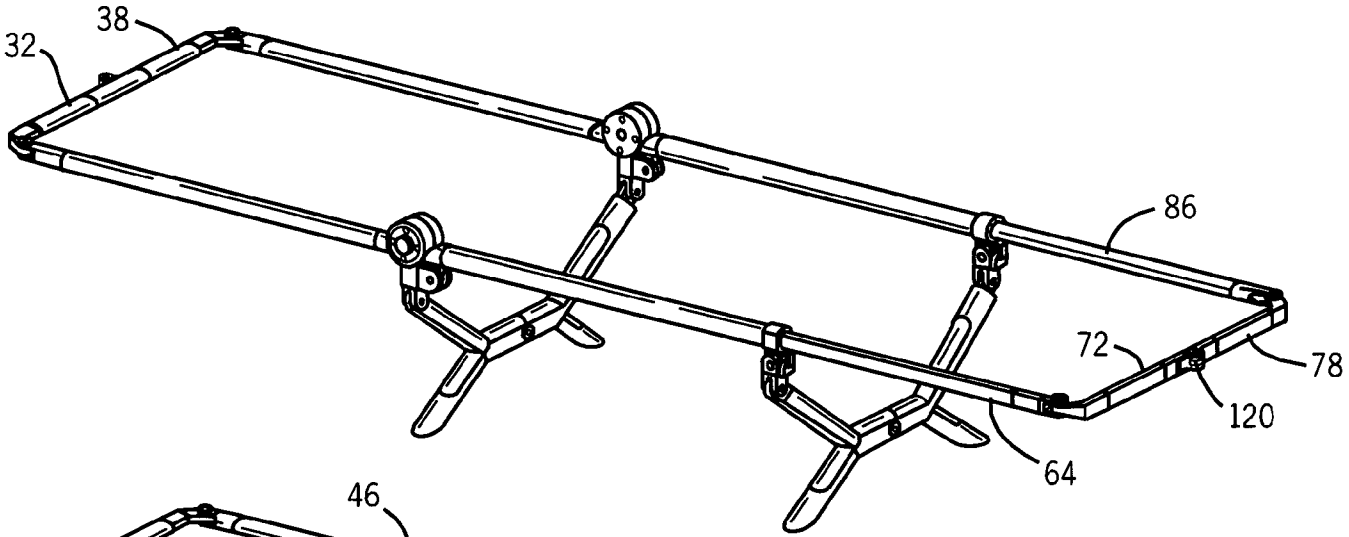
FIG. 4A of the drawings is a perspective view of a frame sub-assembly fabricated in accordance with the present invention, showing the leg support section extended in an operative chaise or lounge configuration.
Figure 4B:
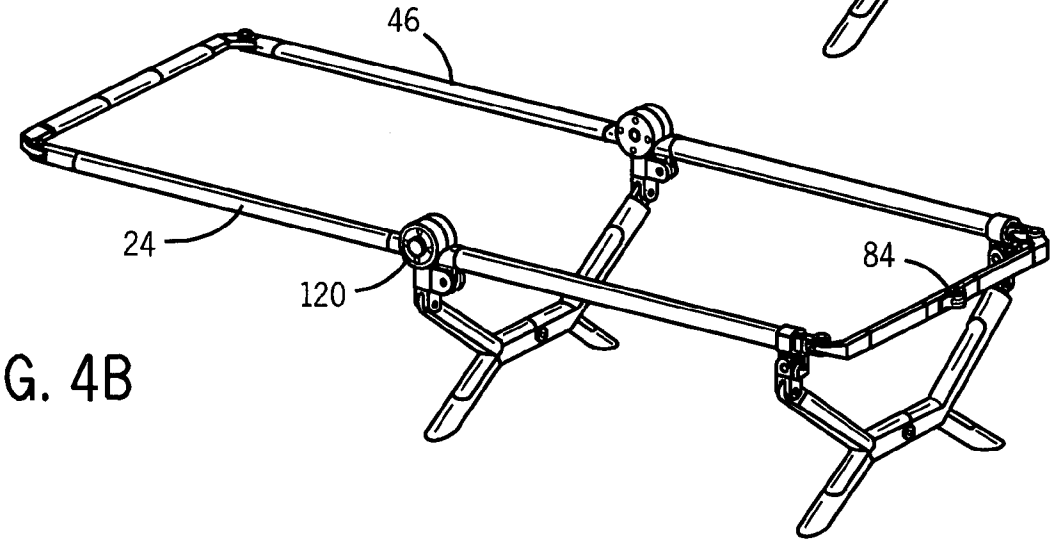
FIG. 4B of the drawings is a perspective view of a frame sub-assembly fabricated in accordance with the present invention, showing the leg support section retracted in an operative chair configuration.
Figures 5A, 5B:
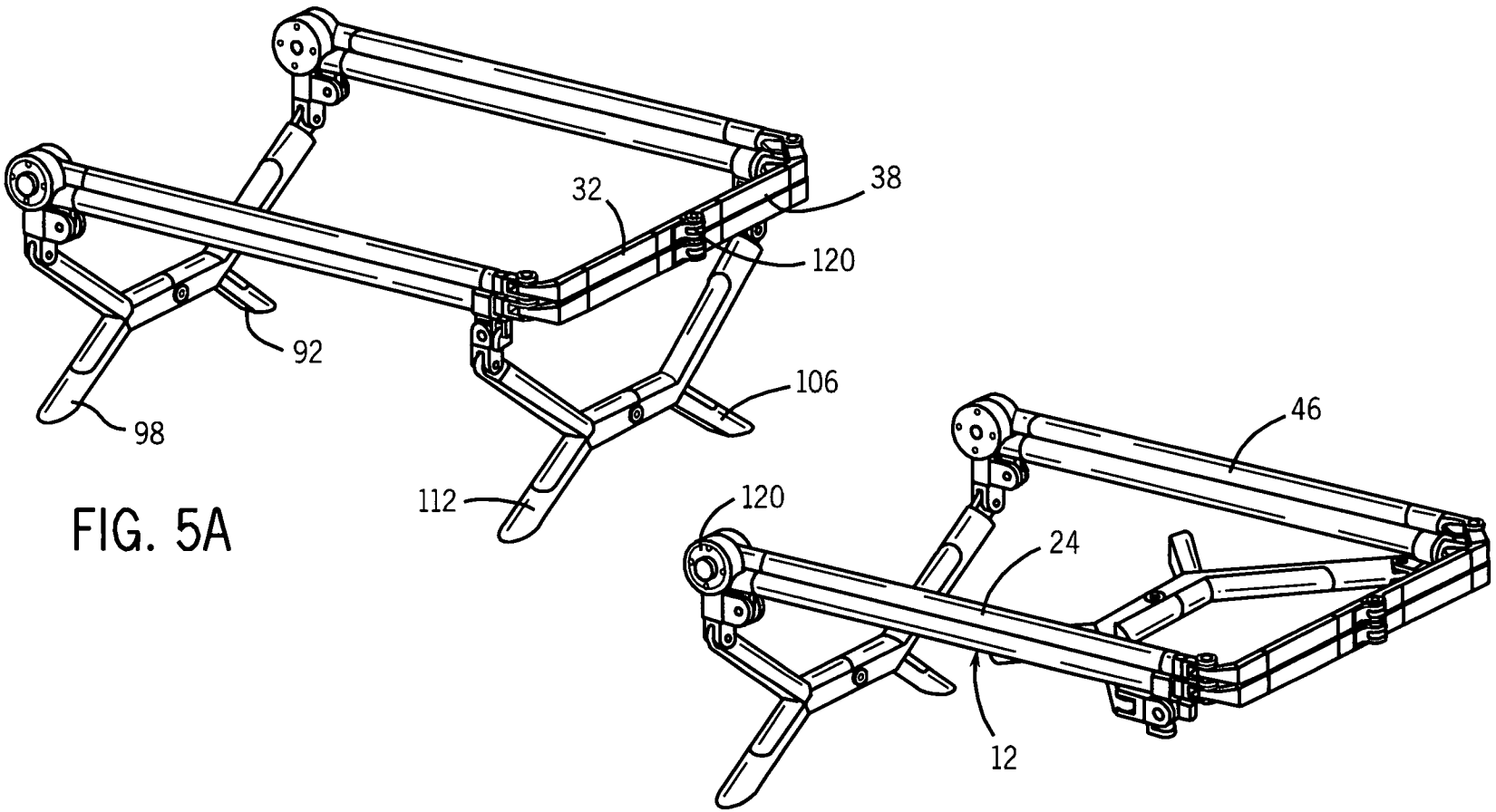
FIG. 5A of the drawings is a perspective view of a frame sub-assembly fabricated in accordance with the present invention, showing the back section folded onto the seat section with the ground engaging leg sub-assembly fully deployed.
FIG. 5B of the drawings is a perspective view of a frame sub-assembly fabricated in accordance with the present invention, showing the back section folded onto the seat section with the ground engaging leg sub-assembly partially collapsed.
Figure 6A:
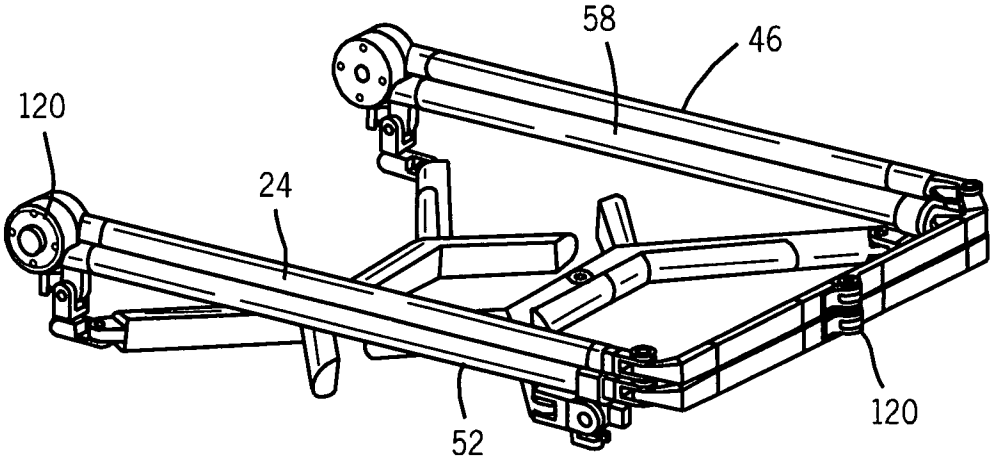
FIG. 6A of the drawings is a perspective view of a frame sub-assembly fabricated in accordance with the present invention, showing the back section folded onto the seat section with the ground engaging leg sub-assembly fully collapsed.
Figure 6B:
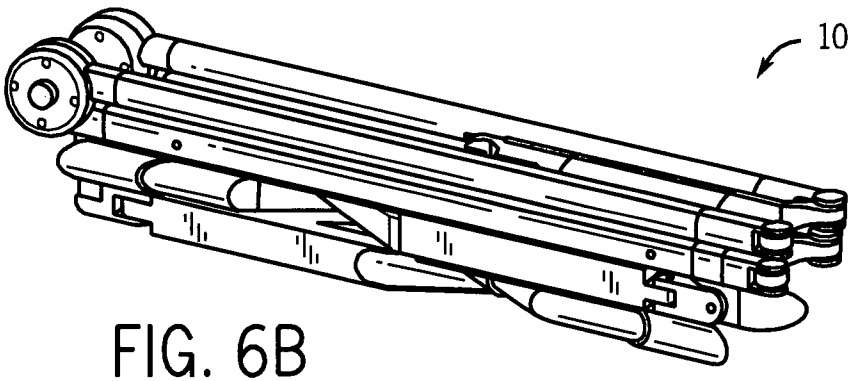
FIG. 6B of the drawings is a perspective view of a frame sub-assembly fabricated in accordance with the present invention, showing the back section folded onto the seat section with the ground engaging leg sub-assembly fully collapsed and converted into an inoperative storage configuration.
Figure 7A:
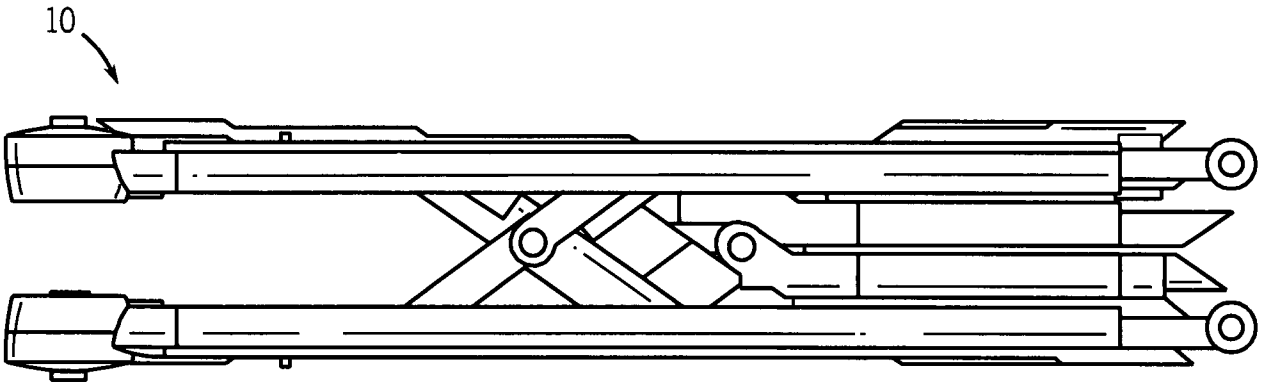
FIGS. 7A-7C of the drawings are multiple views of a frame sub-assembly fabricated in accordance with the present invention, in an inoperative storage configuration.
Figure 7B:
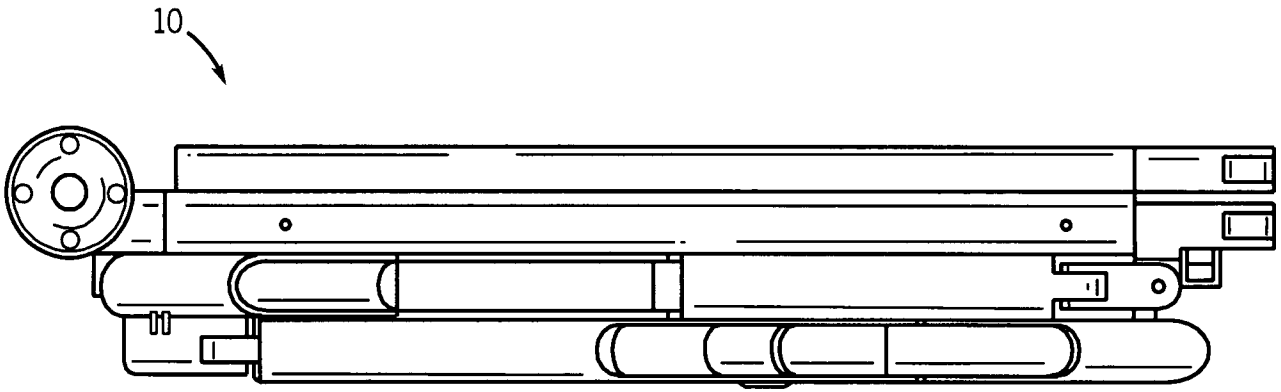
Figure 7C:
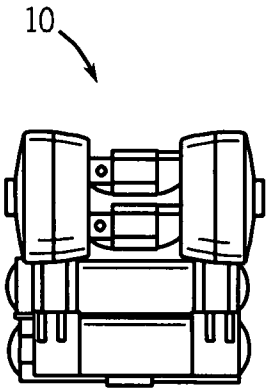

While this invention is susceptible of embodiment in many different forms, there is shown in the drawings and described herein in detail several specific embodiments with the understanding that the present disclosure is to be considered as an exemplification of the principles of the invention and is not intended to limit the invention to the embodiments illustrated.

It will be understood that like or analogous elements and/or components, referred to herein, may be identified throughout the drawings with like reference characters.

In accordance with the present invention, the seating assemblies disclosed herein are adapted to be readily converted between an inoperative storage configuration and multiple operative seating configurations. The seating assemblies further comprise adjustable headrests/towel holders, magazine holders, accessory holders, (e.g., personal articles, paraphernalia, music players, drink bottles, etcetera)—just to name a few.

Figure 8:
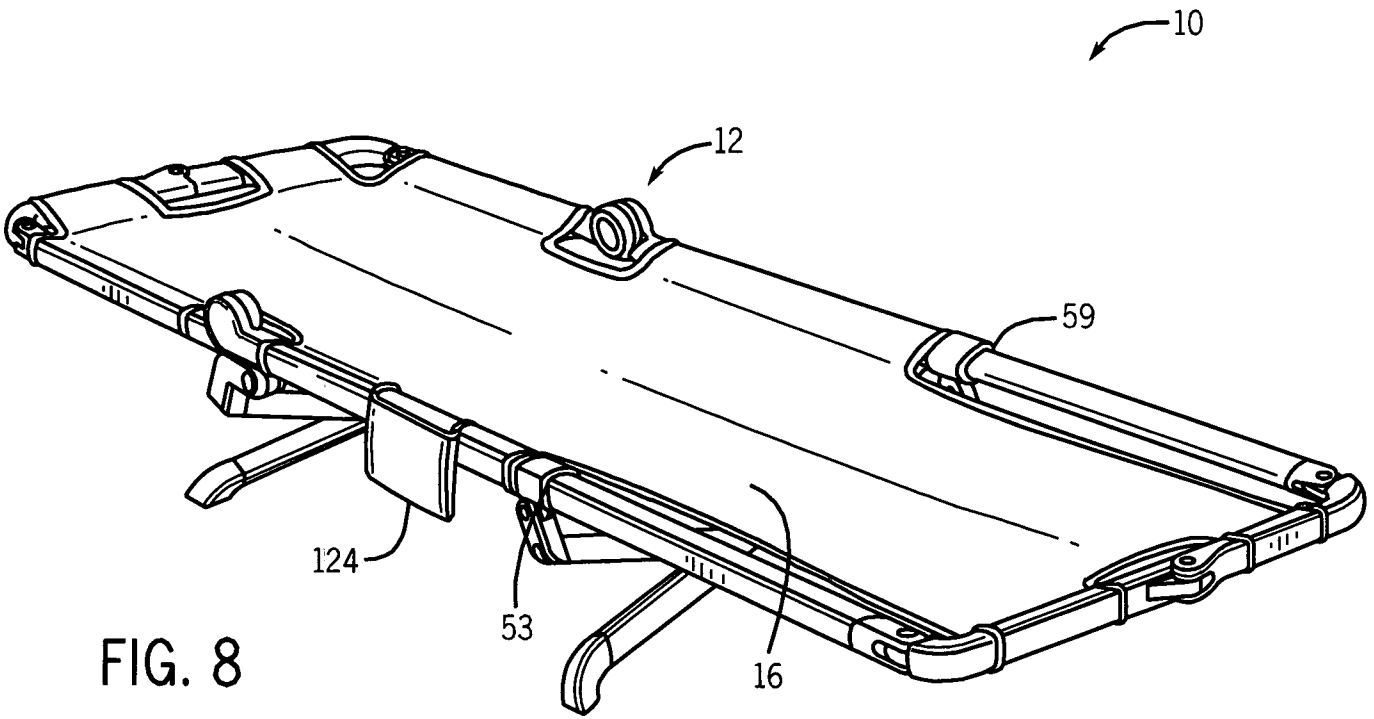
FIG. 8 of the drawings is a perspective view of a seating assembly fabricated in accordance with the present invention, in an operative chaise or lounge configuration.

Referring now to the collective drawings (i.e., FIGS. 1-11), and to FIG. 1 in particular, a perspective view of a first embodiment of seating assembly 10 is shown which generally comprises frame sub-assembly 12, ground engaging leg sub-assembly 14, and body support member 16 (FIG. 8). It will be understood that FIGS. 1-11 are merely pictorial representations and/or illustrations of the seating assemblies. As such, some of the components may be distorted from their actual scale for pictorial clarity and/or image enhancement.

In a preferred embodiment of the present invention, frame sub-assembly 12 comprises back section 18, seat section 20, and leg support section 22.

Preferably, back section 18 comprises: (a) left frame member 24 having upper end 26 and lower end 28; (b) top frame member 30 having left section 32 which includes left end 34 and right end 36, right section 38 which includes left end 40 and right end 42, and midpoint 44 between left and right sections 32 and 38, respectively; and (c) right frame member 46 having upper end 48 and lower end 50.

In one embodiment of the present invention, left frame member 24, top frame member 30, and right frame member 46 collectively form a substantially U-shaped back section.

In accordance with the present invention, back section 18 includes a plurality of connective hinges 120 which collectively facilitate conversion of the seating assembly between an inoperative storage configuration (e.g., FIGS. 7A-7C) and multiple operative seating configurations (e.g., FIGS. 8-11).

In particular, back section 18 includes three connective hinges 120, namely: (a) upper end 26 of left frame member 24 and left end 34 of left section 32 of top frame member 30 are connected via hinge 120; (b) upper end 48 of right frame member 46 and right end 42 of right section 38 of top frame member 30 are connected via hinge 120; and (c) right end 36 of left section 32 of top frame member 30 and left end 40 of right section 38 of top frame member 30 are connected proximate midpoint 44 of top frame member 30 via hinge 120—which is preferably a releasably lockable hinge.

Preferably seat section 20 comprises: (a) left frame member 52 having cavity 53 (FIG. 8), upper end 54, and lower end 56; and (b) right frame member 58 having cavity 59 (FIG. 8), upper end 60 and lower end 62.

In accordance with the present invention, seat section 20 also includes a plurality of connective hinges 120 which collectively facilitate conversion of the seating assembly between an inoperative storage configuration (e.g., FIGS. 7A-7C) and multiple operative seating configurations (e.g., FIGS. 8-11).

In particular, seat section 20 includes two connective hinges 120, namely: (a) upper end 54 of left frame member 52 of seat section 20 and lower end 28 of left frame member 24 of back section 18 are connected via hinge 120; and (b) upper end 60 of right frame member 58 of seat section 20 and lower end 50 of right frame member 46 of back section 18 are connected via hinge 120. It will be understood that hinges 120 are preferably releasably lockable.

Preferably leg support section 22 comprises: (a) left frame member 64 having upper end 66 and lower end 68; (b) bottom frame member 70 having left section 72 which includes left end 74 and right end 76, and right section 78 which includes left end 80 and a right end 82, and midpoint 84 between left and right sections 72 and 78, respectively; and (c) right frame member 86 having upper end 88 and lower end 90.

In one embodiment of the present invention, left frame member 64, bottom frame member 70, and right frame 86 member collectively form a substantially U-shaped back section when the leg support section of the seating assembly is in an extended configuration.

In accordance with the present invention, leg support section 22 includes a plurality of connective hinges 120 which collectively facilitate conversion of the seating assembly between an inoperative storage configuration (e.g., FIGS. 7A-7C) and multiple operative seating configurations (e.g., FIGS. 8-11).

In particular, leg support section 22 includes three connective hinges 120, namely: (a) lower end 68 of left frame member 64 and left end 74 of left section 72 of bottom frame member 70 are connected via hinge 120; (b) lower end 90 of right frame member 86 and right end 82 of right section 78 of bottom frame member 70 are connected via hinge 120; and (c) right end 76 of left section 72 of bottom frame member 70 and left end 80 of right section 78 of bottom frame member 70 are connected proximate midpoint 84 of bottom frame member 70 via hinge 120—which is preferably a releasably lockable hinge.

In one embodiment of the present invention, ground engaging leg sub-assembly 14 preferably comprises: (a) first leg 92 having upper end 94 and lower end 96; (b) second leg 98 having upper end 100 and lower end 102 which are hingedly connected proximate midpoint 104; (c) third leg 106 having upper end 108 and lower end 110; and (d) fourth leg 112 having upper end 114 and lower end 116 which are hingedly connected proximate midpoint 118.

Preferably, upper end 94 of first leg 92 is hingedly connected to upper end 54 of left frame member 52 of seat section 20, and upper end 100 of second leg 98 is hingedly connected to upper end 60 of right frame member 58 of seat section 20. It is additionally preferred that upper end 108 of third leg 106 is hingedly connected to lower end 56 of left frame member 52 of seat section 20, and upper end 114 of fourth leg 112 is hingedly connected to lower end 62 of right frame member 58 of the seat section 20.

It will be understood that frame sub-assembly 12 and ground engaging leg sub-assembly 14 are preferably fabricated from metals, non-metals, ceramics, wood, and/or plastics. Specific examples include extruded aluminum, stainless steel or other acceptable metals, etcetera.

As is best shown in FIGS. 8-11, body support member 16 is associated with frame sub-assembly 12 and serves to retain and/or hold an individual on seating assembly 10. For purposes of the present disclosure body support member 16 is preferably, but not necessarily, fabricated from a breathable material—such as natural and/or synthetic materials. Specific examples include canvas, cotton, plastic, webbings, and the like. It will be understood that body support member 16 can be associated with frame sub-assembly 12 using any one of a number of attachment techniques, including, but not limited to, adhesives, hook and loop fasteners, stitching, and combinations thereof.

Referring now to FIGS. 8-11, seating assembly 10 may optionally include pocket 124, which is associated with the side of seat section 20. Pocket 124 preferably retains/contains music players, drinking bottles or cans, personal and/or miscellaneous articles, paraphernalia, etcetera. It will be understood that pocket 124 may be associated with seat section 20 via stitching, hook and loop fasteners, adhesives—just to name a few.

In certain configurations, seating assembly 10 also comprises pocket or sleeve 122, which is associated with leg support section 22. Pocket or sleeve 122 preferably retains magazines, books, papers, etcetera.

Figure 9:
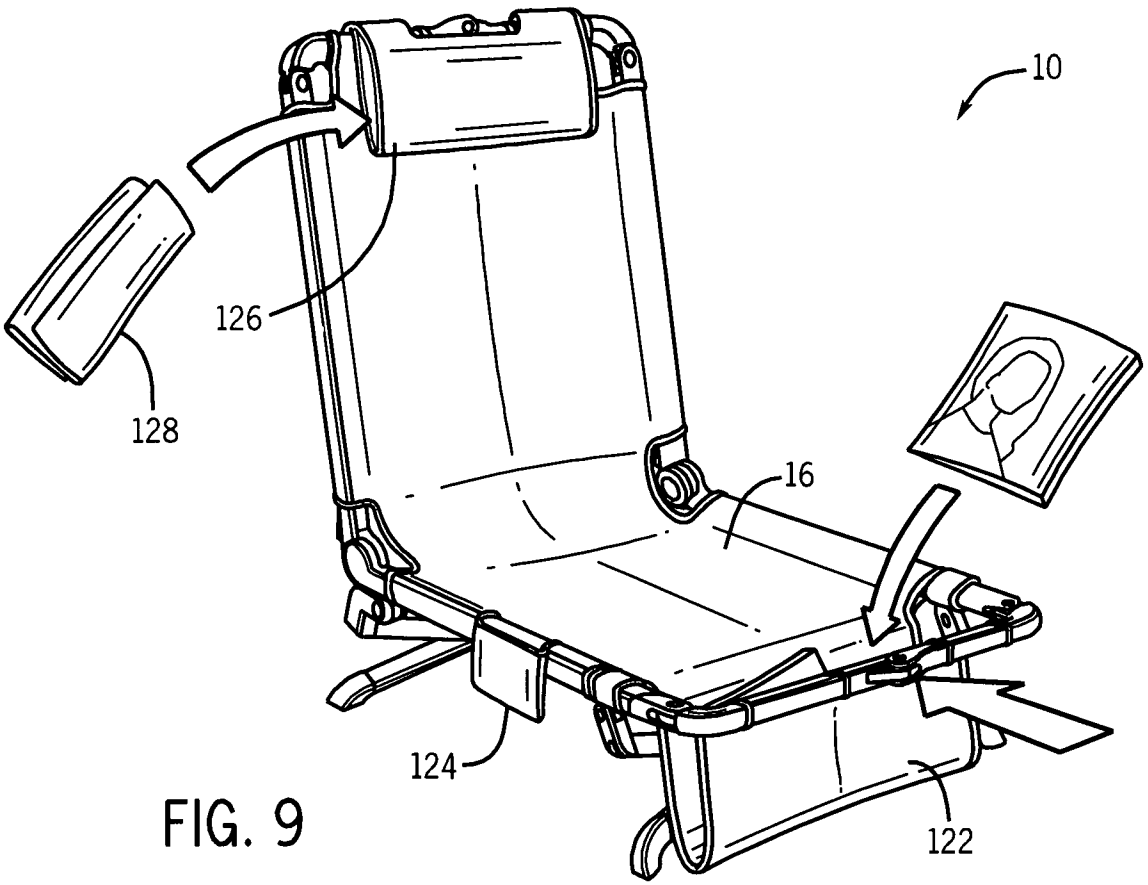
FIG. 9 of the drawings is a perspective view of a seating assembly fabricated in accordance with the present invention, in an operative chair configuration showing a magazine holder, accessory holder, (e.g., personal articles, paraphernalia, music players, drink bottles, etcetera) and adjustable towel holder/headrest.

As is best shown in FIG. 9, and in one embodiment of the present invention, seating assembly 10 comprises adjustable headrest 126, which is adapted to conveniently receive and retain, for example, towel 128. It will be understood that headrest 126 may be associated with back section 18 via stitching, hook and loop fasteners, adhesives—just to name a few.

It will be understood that assembly of seating assembly 10 is accomplished via traditional methods known to those having ordinary skill in the art.

Figure 10:
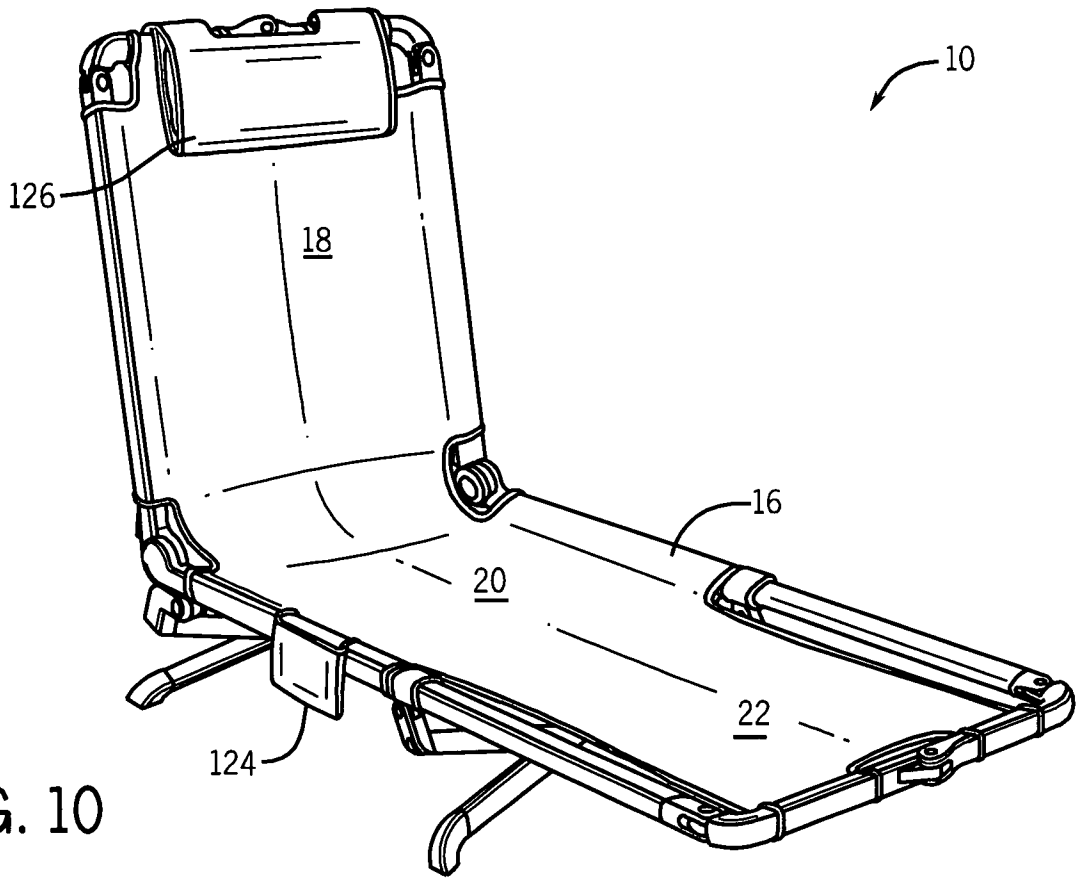
FIG. 10 of the drawings is a perspective view of a seating assembly fabricated in accordance with the present invention, in an operative chaise or lounge configuration showing a back section in a substantially upright position.
Figure 11:
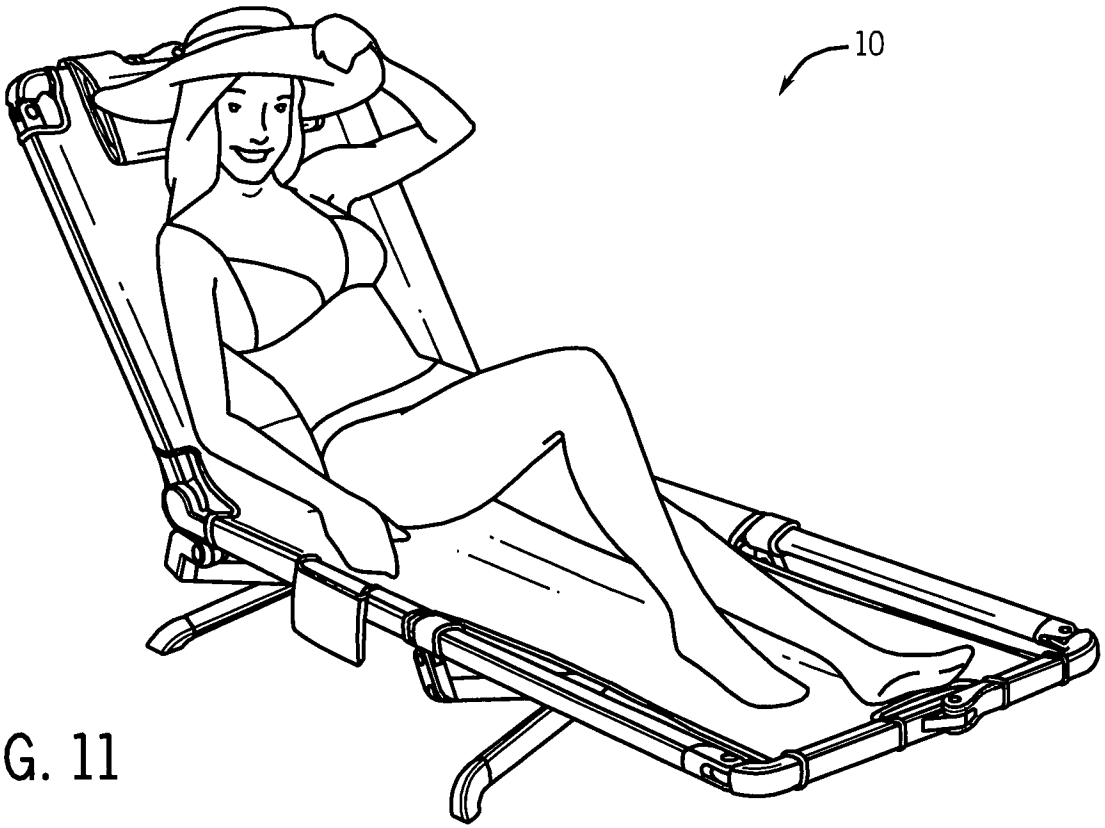
FIG. 11 of the drawings is a perspective view of a seating assembly fabricated in accordance with the present invention, in an operative chaise or lounge configuration showing a back section in a substantially upright position with an individual thereon.

In accordance with the present invention, FIGS. 1-11 collectively disclose a plurality of configurations for which seating assembly 10 is readily capable of adaptation to and from. In particular, a user will first normally convert seating assembly 10 from an inoperative, storage configuration (FIGS. 6B-7C) to an operative seating configuration via manipulation of seating assembly 10 in accordance with the steps chronologically shown in FIG. 6B, FIG. 6A, FIG. 5B, FIG. 5A, and FIG. 1. It will be understood that conversion back to an inoperative, storage configuration is achieved via reverse chronology of these same steps. It will be further understood that back section 18 is variably and lockably positionable between approximately 0 degrees and 90 degrees relative to seat section 20 while in an operative seating configuration. It will be yet further understood that leg support section 22 is variably and slidably positionable between a chair (non-extended) configuration (FIG. 9) and a lounge/chaise (extended) configuration (FIG. 10).

The foregoing description merely explains and illustrates the invention and the invention is not limited thereto except insofar as the appended claims are so limited, as those skilled in the art who have the disclosure before them will be able to make modifications without departing from the scope of the invention.

What is claimed and desired to be secured by Letters Patent of the United States is:

1. A seating assembly adapted to be readily converted between an inoperative storage configuration and multiple operative seating configurations, comprising:

a frame sub-assembly, wherein the frame sub-assembly comprises a back section, a seat section, and a leg support section;

wherein the back section comprises:

a left frame member having an upper end and a lower end;

a top frame member having a left section which includes a left end and a right end, and a right section which includes a left end and a right end, and a midpoint between the left and right sections;

a right frame member having an upper end and a lower end;

wherein the left frame member, the top frame member and the right frame member collectively form a U-shaped back section;

wherein the upper end of the left frame member and the left end of the left section of the top frame member are hingedly connected;

wherein the upper end of the right frame member and the right end of the right section of the top frame member are hingedly connected; and wherein the right end of the left section of the top frame member and the left end of the right section of the top frame member are connected via a releasably lockable hinge proximate the midpoint of the top frame member;

wherein the seat section comprises:

a left frame member having a cavity, an upper end, and a lower end;

and a right frame member having a cavity, an upper end, and a lower end;

wherein the upper end of the left frame member of the seat section and the lower end of the left frame member of the back section are connected via a releasably lockable hinge; and wherein the upper end of the right frame member of the seat section and the lower end of the right frame member of the back section are connected via a releasably lockable hinge;

wherein the leg support section comprises:

a left frame member having an upper end and a lower end;

a bottom frame member having a left section which includes a left end and a right end, and a right section which includes a left end and a right end, and a midpoint between the left and right sections;

a right frame member having an upper end and a lower end;

wherein the left frame member, the bottom frame member, and the right frame member collectively form a U-shaped leg support section which is telescopically displaceable relative to the seat section;

wherein the lower end of the left frame member and the left end of the left section of the bottom frame member are hingedly connected;

wherein the lower end of the right frame member and the right end of the right section of the bottom frame member are hingedly connected; and wherein the right end of the left section of the bottom frame member and the left end of the right section of the bottom frame member are connected via a releasably lockable hinge proximate the midpoint of the bottom frame member;

a ground engaging leg sub-assembly, wherein the ground engaging leg sub-assembly comprises:

a first leg having an upper end and a lower end;

a second leg having an upper end and a lower end;

a third leg having an upper end and a lower end;

a fourth leg having an upper end and a lower end;

wherein the upper end of the first leg is hingedly connected to the upper end of the left frame member of the seat section, and the upper end of the second leg is hingedly connected to the upper end of the right frame member of the seat section; and wherein the upper end of the third leg is hingedly connected to the lower end of the left frame member of the seat section, and the upper end of the fourth leg is hingedly connected to the lower end of the right frame member of the seat section; and a body support member.

2. The seat assembly according to claim 1, further comprising a pocket associated with the seat section.

3. The seat assembly according to claim 1, further comprising a headrest associated with the back section, wherein the headrest is adapted to releasably retain a towel.

4. A seating assembly adapted to be readily converted between an inoperative storage configuration and multiple operative seating configurations, comprising:

a frame sub-assembly, wherein the frame sub-assembly comprises a back section, a seat section, and a leg support section;

wherein the back section comprises:

a left frame member having an upper end and a lower end;

a top frame member having a left section which includes a left end and a right end, and a right section which includes a left end and a right end, and a midpoint between the left and right sections; and a right frame member having an upper end and a lower end;

wherein the upper end of the left frame member and the left end of the left section of the top frame member are hingedly connected;

wherein the upper end of the right frame member and the right end of the right section of the top frame member are hingedly connected; and wherein the right end of the left section of the top frame member and the left end of the right section of the top frame member are hingedly connected;

wherein the seat section comprises:

a left frame member having a cavity, an upper end, and a lower end;

and a right frame member having a cavity, an upper end, and a lower end;

wherein the upper end of the left frame member of the seat section and the lower end of the left frame member of the back section are hingedly connected; and wherein the upper end of the right frame member of the seat section and the lower end of the right frame member of the back section are hingedly connected;

wherein the leg support section comprises:

a left frame member having an upper end and a lower end;

a bottom frame member having a left section which includes a left end and a right end, and a right section which includes a left end and a right end, and a midpoint between the left and right sections;

a right frame member having an upper end and a lower end;

wherein the left frame member, the bottom frame member, and the right frame member collectively form a U-shaped leg support section which is telescopically displaceable relative to the seat section;

wherein the lower end of the left frame member and the left end of the left section of the bottom frame member are hingedly connected;

wherein the lower end of the right frame member and the right end of the right section of the bottom frame member are hingedly connected; and wherein the right end of the left section of the bottom frame member and the left end of the right section of the bottom frame member are hingedly connected;

a ground engaging leg sub-assembly; and a body support member.

5. The seat assembly according to claim 4, wherein the left frame member of the back section, the top frame member of the back section, and the right frame member of the back section collectively form a U-shaped back section.

6. The seat assembly according to claim 4, further comprising a headrest associated with the back section, wherein the headrest is adapted to releasably retain a towel.

7. The seat assembly according to claim 4, wherein the right end of the left section of the top frame member of the back section and the left end of the right section of the top frame member of the back section are connected via a releasably lockable hinge.

8. The seat assembly according to claim 4, wherein the right end of the left section of the bottom frame member of the leg support section and the left end of the right section of the bottom frame member of the leg support section are connected via a releasably lockable hinge.

9. The seat assembly according to claim 4, wherein the upper end of the left frame member of the seat section and the lower end of the left frame member of the back section are connected via a releasably lockable hinge.

10. The seat assembly according to claim 4, wherein the upper end of the right frame member of the seat section and the lower end of the right frame member of the back section are connected via a releasably lockable hinge.

11. The seat assembly according to claim 4, wherein the ground engaging leg sub-assembly comprises a first leg having an upper end and a lower end, and a second leg having an upper end and a lower end which are hingedly connected proximate a midpoint.

12. The seat assembly according to claim 11, wherein the ground engaging leg sub-assembly comprises a third leg having an upper end and a lower end, and a fourth leg having an upper end and a lower end which are hingedly connected proximate a midpoint.

13. The seat assembly according to claim 11, wherein the upper end of the first leg is hingedly connected to the upper end of the left frame member of the seat section and the upper end of the second leg is hingedly connected to the upper end of the right frame member of the seat section.

14. The seat assembly according to claim 12, wherein the upper end of the third leg is hingedly connected to the lower end of the left frame member of the seat section and the upper end of the fourth leg is hingedly connected to the lower end of the right frame member of the seat section.

15. The seat assembly according to claim 4, further comprising a pocket associated with the seat section.

16. A seating assembly, comprising:

a frame sub-assembly; a ground engaging leg sub-assembly; and a body support member;

wherein the frame sub-assembly comprises a back section; a seat section having a left frame member with a cavity, and a right frame member with a cavity; and a leg support section having a left frame member and a right frame member;

wherein the seating assembly is convertible between an inoperative storage configuration and an operative seating configuration; and wherein the operative seating configuration is further convertible between a chair configuration and a lounge configuration upon displacement of the left and right frame members of the leg support section from within the cavities of the seat section.

* * * * *